US007264452B2

(12) United States Patent
Sbarounis

(10) Patent No.: US 7,264,452 B2
(45) Date of Patent: Sep. 4, 2007

(54) ROTOR POSITION CONTROL FOR ROTARY MACHINES

(76) Inventor: Joaseph A. Sbarounis, 138 Prince St., Apt. 1, Boston, MA (US) 02113

( * ) Notice: Subject to any disclaimer, the term of this patent is extended or adjusted under 35 U.S.C. 154(b) by 253 days.

(21) Appl. No.: 11/025,588

(22) Filed: Dec. 29, 2004

(65) Prior Publication Data

US 2006/0140808 A1 Jun. 29, 2006

(51) Int. Cl.
*F04C 2/00* (2006.01)
*F03C 2/00* (2006.01)

(52) U.S. Cl. ..... 418/54; 418/61.2; 418/125; 418/248

(58) Field of Classification Search ..... 418/54, 418/61.2, 125, 248
See application file for complete search history.

(56) References Cited

U.S. PATENT DOCUMENTS

| | | | | |
|---|---|---|---|---|
| 298,952 | A | 5/1884 | Donkin | |
| 1,340,625 | A | 5/1920 | Planche | |
| 3,348,529 | A * | 10/1967 | Assum | 418/57 |
| 3,800,760 | A | 4/1974 | Knee | |
| 3,938,919 | A | 2/1976 | Huf et al. | |
| 3,966,370 | A | 6/1976 | Huf | |
| 3,967,591 | A * | 7/1976 | Iida | 122/32 |
| 4,167,375 | A * | 9/1979 | Doshi | 418/54 |
| 4,300,874 | A | 11/1981 | Georgiev | |
| 4,345,886 | A | 8/1982 | Nakayama et al. | |
| 5,393,208 | A | 2/1995 | Sbarounis | |
| 6,799,955 | B1 * | 10/2004 | Sbarounis | 418/54 |
| 6,974,313 | B2 * | 12/2005 | Beaudoin | 418/54 |

FOREIGN PATENT DOCUMENTS

| | | | |
|---|---|---|---|
| GB | 258 | 0/1853 | |
| WO | WO8801696 A1 * | 3/1988 | 418/61.2 |

* cited by examiner

*Primary Examiner*—Theresa Trieu
(74) *Attorney, Agent, or Firm*—Fitch, Even, Tabin & Flannery

(57) ABSTRACT

Improved rotor position control for rotary machines allows for positioning mechanisms which are more compact, relative to the stroke of the machine. A crank having a center shaft which extends through the rotor chamber is rotatably mounted in a forward in wall of the chamber. An eccentric shaft of the crank is rotatably mounted by the rotor and is aligned with rotor axis. A stationary gear extends into the rotor chamber and is rigidly mounted in a forward in wall of the chamber. A crank web is connected to the center shaft rearward of the stationary gear. The eccentric shaft passes through the rotor gear and is connected to the crank web forward of the rotor gear. The rotor gear has a pitch radius greater than that of the stationary gear by a ratio of the number of lobes of the rotor divided by the number of lobes minus one. A re versing gear is rigidly mounted to the crank web and has a center axis offset from that of the rotor by a distance equal to the stationary gear pitch radius plus the reversing gear pitch radius.

12 Claims, 10 Drawing Sheets

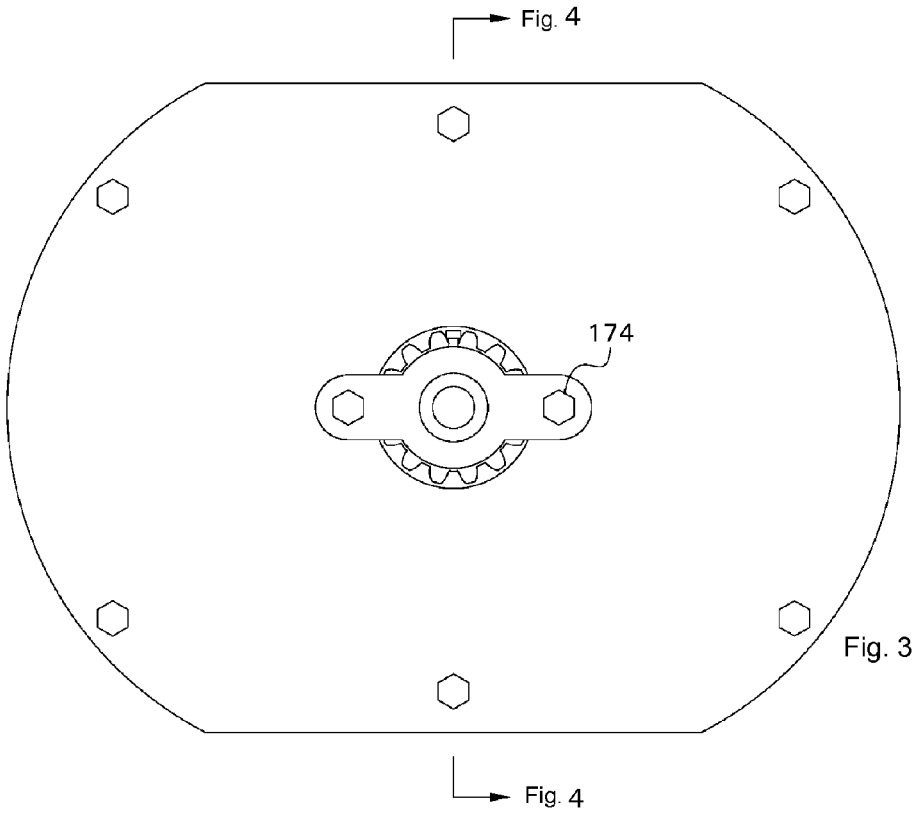
Fig. 3
Fig. 4
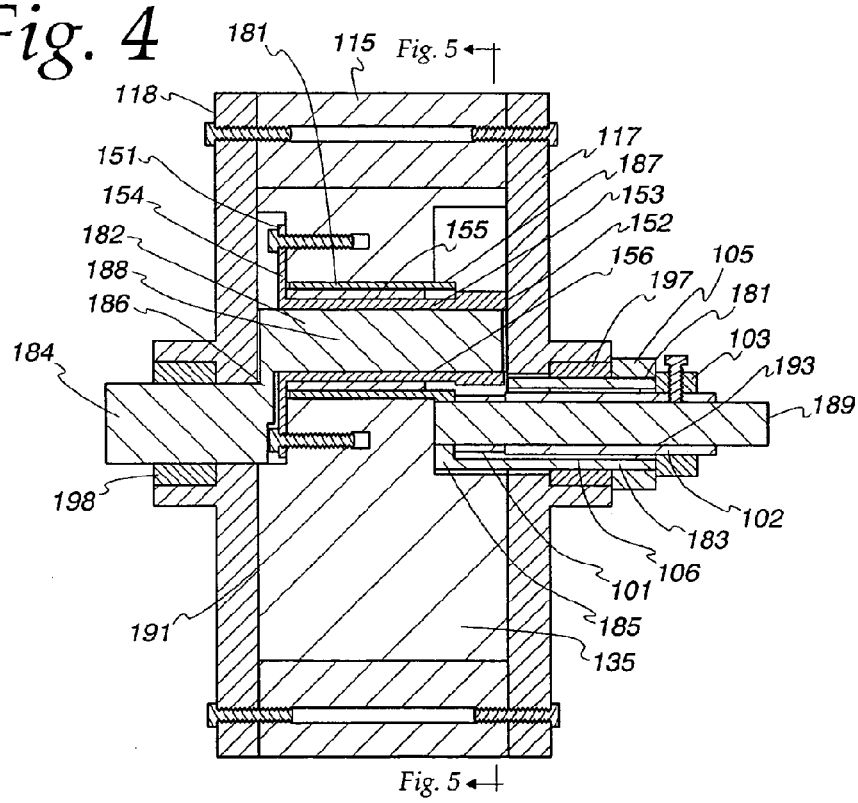

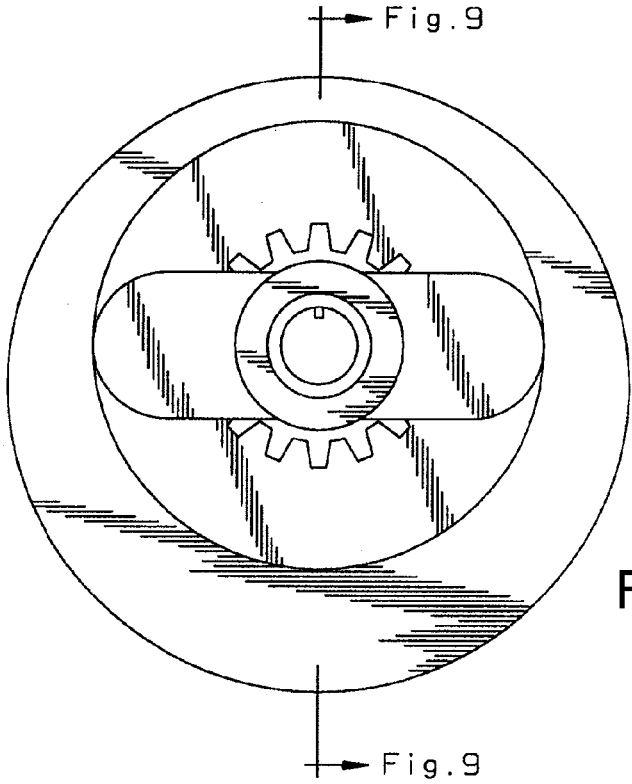
Fig. 8
Fig. 9
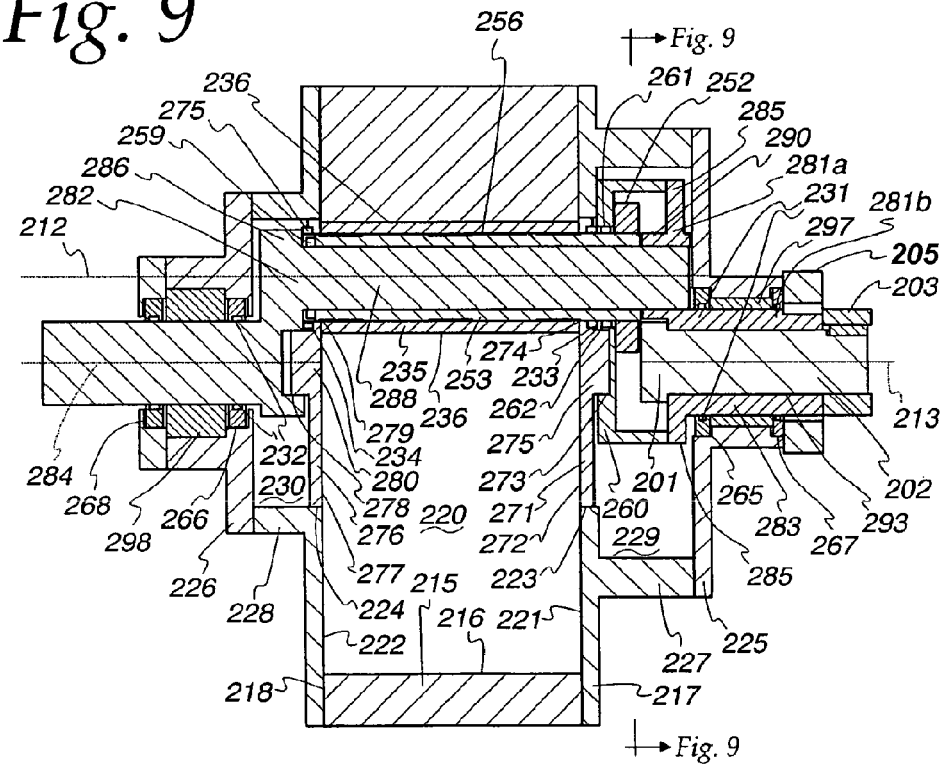

ROTOR POSITION CONTROL FOR ROTARY MACHINES

BACKGROUND OF THE INVENTION

1. Field of the Invention

The present invention relates generally to rotary machines, and more particularly, to positioning the rotor apices of cartiodal rotary machines having two or more lobes and one or more cartiodal projections in the housing.

2. Description of the Related Art

The positioning mechanism for the rotor of cartiodal rotary machines essentially steps down the relative rotational speed of the rotor. The speed reduction is in a 1:2 ratio for the two-lobe machine, 2:3 ratio for the three-lobe rotor, and so forth up to any number of lobes. The mechanisms are numerous, the best known probably being the internal gear of the Wankle or Mazda engine that has a pitch diameter of 1.5 times the pitch diameter of the fixed spur gear.

An important consideration is the passage of the shaft through the positioning mechanism for this class of rotary machine. There are several advantages to this. The first is in that the shaft can be supported on both sides of the rotor. Another advantage is that the alignment for the positioning mechanism is much better when the shaft rotates in a bearing positioned near the mechanism. This becomes of greater consideration when the rotor is long relative to the stroke. Finally, for a rotor that is supported by a bearing only on the side having the positioning element, one end of the rotor can be capped, which eliminates the need for any moving seals on the unsupported side of the rotor. The rotor can essentially be tapered to a small distance between apexes and twisted around to shapes designed for improved flow of liquids or gases.

Rotary machines of this type have a longer stroke relative to the overall size of the rotor, and behave somewhat differently than those with shorter strokes. The rotor occupies a much smaller volume of the chamber and consequently has much less mass, while the shaft is also of lighter construction. These characteristics, although for the most part a disadvantage for high power density of the flow medium, are of significant benefit for lower overall pressure applications.

A sizeable gap between the rotor tips and chamber wall for the machine can still allow effective operation as an expansive device for lower pressure ratios and high RPM. The pressure ratio thus will have smaller variations over a high range of RPM when compared to turbo machinery. The positive displacement machine applied to increasing inlet pressure of an engine is beneficial in this respect, but has the disadvantage of not using the exhaust energy.

The use of a positive displacement machine in place of an exhaust turbine for an engine in concept is recognized as being possible. The obstacles to employing such a device are numerous. It is helpful to clarify these by drawing a contrast to the turbocharger. There are two fundamental schemes for the employment of a positive displacement device as opposed to the one familiar fundamental scheme employed with the exhaust turbine.

The exhaust turbine is connected to the outlet of the engine's cylinders by a tube that has a volume contained within. The exhaust turbine expands the exhaust gases from the engine and to some degree converts the velocity head behind the shock wave passing from the cylinder into power. The design approach in concept is to create the lowest back pressure on the engine while producing sufficient power for the turbo compressor. The design is complicated because most engines must operate over a wide load range and RPM range. At heavy load, there is more energy in the exhaust stream than is required, so a waste gate diverts the exhaust around the turbine. Attempts to use this flow to power an additional turbine are seldom practical because much of the pressure is lost in the exhaust shock wave and the full load condition is intermittent. The cylinder outlet pressure being kept at the fully expanded pressure in the cylinder but when the exhaust valve is closed would leave hot gases in the cylinder at higher pressure than the inlet condition for the cylinder. That condition is not practical for the engine.

The positive displacement device can be employed as the turbocharger in essentially the same manner. The first obstacle is the device has in the past been much larger than the turbine it would replace. A relatively large device will absorb and need to dissipate a great deal of heat. Expansion of larger parts at increased temperature and survivability of the mechanism then also becoming a major factor. Finally, carbon deposits and oxidation within the chamber over the life of the engine are detrimental. The creation of a much smaller positive displacement rotary machine for this application with thermal protection of lubricated surfaces overcomes much of this. The next to overcome is similar in nature to the turbocharger in that consideration of the back pressure on the cylinder must be balanced with efficient expansion of gases and the exhaust shock wave conversion to power. The shaft of the positive displacement device can be coupled to the engine and stepped up and down in speed, a waste gate can be employed, a generator can be coupled, and the device can have a number of schemes to control the flow. The shock wave for example will carry a charge of gases into the chamber if the rotor is somewhat beyond top dead center then expand these before being able to flow back towards the cylinder. The range of exhaust pressure for different engine loads and wide RPM range is difficult to control.

The cyclic nature of the rotary machine in contrast allows for a different approach than the exhaust turbine. For example, the exhaust charge from the piston engine can be fully expanded if the expansion is timed with the movement of the piston of the engine, which allows one expandor to handle four pistons if rotating at twice the RPM of the engine. Additionally, the inlet to the expandor is very close or attached directly to the exhaust manifold. Assuming in theory that a compact device with the ability to survive the life of the engine existed, then one could speculate as to the behavior for the gasoline, diesel or hydrogen powered engine. The device for a naturally aspirated engine could for example have two or three times the volume of one of the four cylinders, and an engine running with an inlet compressor would have a commensurately larger volume expandor. The condition then exists that under low load for the engine, there is too much of a vacuum pulled on the cylinder. Control for this scheme however is in concept simpler than the first approach discussed, and some of these approaches are as follows.

An expandor having a variable expansive volume is one method of accommodating the range of cylinder outlet pressures resulting from different engine loads. This can be achieved in a number of fashions, but the most straightforward is to open a flow channel in the rotary expandor outlet that is at midway through the expansion cycle. This will route flow from down stream of the outlet back into the expandor. Another method is to use a check valve on the expandor outlet. This allows the gases in the expandor chamber to expand to lower pressure than the ambient pressure then repressurize. That is to say the gases are further expanded to negative pressure in the device then repressurize to exit via a reed valve. The gases can even dissipate heat at negative pressure.

The device would not create the constant back pressure of turbo machinery and in theory the overall cycle is more efficient. This is closer to an ideal internal combustion engine cycle that calls for expansion to inlet temperature, which is at far lower pressure than inlet pressure, then recompressing to ambient pressure at the inlet temperature. Ideally, the overall cycle would resemble an open Stirling cycle.

Another method, which has received very little attention, is to actually pull a vacuum on the outlet of the expandor with a turbo compressor for example. The gases from the outlet of the expandor are cooled as much as is practical before recompression. A slight variation of this theme is to put the exhaust turbine on the expandor outlet and use this before the heat exchanger to power the exhaust turbo compressor. What has described from the standpoint of the hardware is very similar to an advanced exhaust gas recirculation pumping system for a diesel engine.

The applications are too numerous to list, but sufficiently small volumetric displacement rate machines for low-pressure applications are useful for quiet operation or where nearly constant pressure over a wide RPM range is desirable.

SUMMARY OF THE INVENTION

One object of the present invention is to provide for an improved cartiodal type rotary machine for use as pumps, compressors, expanders, impellers, or even nonfixed wings.

Another object of the present invention is to allow for the use of a more compact positioning mechanism relative to the stroke.

A further object of the present invention allows for the use of a positioning mechanism isolated by a gear case with relatively small shaft seals.

Another object of the present invention allows for a stationary-positioning element attached to the housing such as a gear, which passes through the shaft along the centerline allowing for a shaft of higher strength.

These and other advantages of the present invention, which will become apparent in the following description and drawings, are attained in a rotary machine comprising:

a housing with spaced apart forward and rearward end walls and an interior wall defining a chamber;

a multi-lobe rotor in said chamber having curved faces meeting at apices, said apices being symmetrically arranged about a rotor axis, said apices positioned in close proximity to the interior wall of said housing, said rotor having parallel forward and rearward end faces extending between said curved faces, each of said parallel end faces facing one of said end walls, said parallel end faces being perpendicular to said rotor axis;

a crank with a center shaft extending along a shaft center axis offset from said rotor axis by a crank length distance, said center shaft extending through said chamber and rotatably mounted in the forward end wall, said crank including an eccentric shaft engaging at least one eccentric bearing supported by said rotor for forming driving contact between said center shaft and said rotor, said eccentric shaft and said eccentric bearing aligned with the rotor axis;

a stationary gear having a pitch radius and extending into the chamber from said forward end wall, said stationary gear rigidly mounted in said forward end wall, inline with the shaft center axis, said center shaft rotatably mounted in said forward end wall, inline with the shaft center axis, said center shaft passing through said stationary gear;

a crank web connecting said center shaft to the eccentric shaft, said crank web connected to said center shaft rearward of said stationary gear;

a rotor gear mounted to said rotor, inline with said rotor axis, said eccentric shaft passing through said rotor gear, and being connected to the crank web forward of said rotor gear, with said eccentric shaft directly accessible from the rearward side of said rotor;

the rotor gear having a rotor gear pitch radius greater than said stationary gear pitch radius by a ratio of the number of lobes of said rotor divided by the number of lobes of said rotor minus one;

a reversing gear having a pitch radius rotatably mounted on a reversing shaft, said reversing shaft rigidly mounted to the crank web, said reversing gear having a gear center axis offset from said center axis by a distance equal to said stationary gear pitch radius plus said reversing gear pitch radius;

said reversing gear having a gear center axis offset from said rotor axis by a distance equal to said rotor gear pitch radius plus said reversing gear pitch radius; and said reversing gear engaging said rotor gear and said stationary gear.

First Embodiment

A first embodiment of the present invention uses a speed reduction for the rotor of two-thirds the shaft's rotational speed. This is associated with the three-lobe rotor design. The same concept applies for a speed reduction of one half, three fourths, or more associated with the multi lobe rotors.

An outer housing having an inwardly facing annular wall, a first end wall or end wall, and a second end wall or end wall when joined together form a machine chamber. The first end wall can be thought can be thought of as the forward end wall. A forward direction is denoted as the direction of said first end wall from machine chamber and a rearward direction as the direction of second end wall from machine chamber.

A rotor is disposed in machine chamber for eccentric rotation therein, said rotor having three curved faces meeting at three apices arranged symmetrically about a rotor central longitudinal axis. A first rotor end and a second rotor end extend in parallel fashion between said curved faces and create a pressure seal by moving in close proximity to said first end wall and said second end wall. A rotor positioning mechanism causes said apices to always move in close proximity to annular wall to form a pressure seal A first crank is comprised of a first center shaft, a first crank web, a first eccentric shaft, and a first auxiliary center shaft and has a center shaft longitudinal axis offset from said rotor center longitudinal axis by a crank length. A first end wall hole allows passage of said first center shaft to forward of said first end wall, said first center shaft joumaled in said first end wall by a first center shaft bearing inline with said center shaft longitudinal axis.

A rotor cylindrical bore is displaced in line with rotor central longitudinal axis in a hole in rotor, said first eccentric shaft joumaled within said rotor cylindrical bore to form a driving contact.

A stationary gear having a pitch diameter "PDst" rigidly connects to a stationary gear hub inline with center shaft longitudinal axis, said stationary gear hub secured to a stationary gear hub retainer, said stationary gear retainer fastened to end wall by bolts. A first center shaft bore extends from forward of said first center shaft into crank web. Although not a requirement, said stationary gear hub is rotatably mounted within said first center shaft bore by stationary gear hub bearing for the purpose of maintaining better alignment with said shaft center longitudinal axis. Direct access to said first center shaft is blocked on the forward side by said stationary gear hub retainer and can not be directly coupled, so a power takeoff gear is shown as an example of indirect coupling to the shaft.

A stationary gear hub bore passes from forward of said stationary gear hub retainer to rearward of said stationary gear with said first auxiliary center shaft rigidly affixed to first crank web and passing to forward of stationary gear hub retainer. Although not a requirement for this embodiment, the auxiliary first center shaft is rotatably mounted within said stationary gear hub bore inline with shaft center longitudinal axis for maintaining better alignment of stationary gear. Said auxiliary first center shaft is directly accessible from forward of the machine. One should also note that the first center shaft rotatably mounted by the center shaft bore on the outside of the stationary gear hub could act as the sole rotary mount for the first center shaft.

A rotor gear assembly is comprised of a rotor gear inline with rotor center longitudinal axis having a pitch diameter "PDrot" equal to 1.5 times "PDst", a rotor gear hub, and a rotor gear hub flange, said rotor gear hub flange attaching to said rotor. A first eccentric shaft bore extends from rearward of said first eccentric shaft to forward of said first crank web in line with rotor center longitudinal axis, said rotor gear hub rotatably mounted therein by a rotor gear hub bearing. Direct access to said first eccentric shaft rearward of said rotor is blocked by said rotor gear hub flange, but said rotor gear hub positions said rotor gear forward of said first crank web and helps maintain alignment.

A reversing gear is rotatably mounted on a reversing gear shaft rigidly mounted in a first crank web hole on first crank web. A first center shaft cutout in said first center shaft allows reversing gear to mesh with stationary gear, said reversing gear also engaging rotor gear, said first center shaft cutout allowing clearance for rotor gear.

A center longitudinal axis of said reversing gear is at a distance of one half the rotor gear pitch diameter "PDrot" plus one half the reversing gear pitch diameter "PDrev" from rotor center longitudinal axis. The center longitudinal axis of said reversing gear at the same time is at a distance of one half said stationary gear pitch diameter "PDst" plus one half said reversing gear pitch diameter "PDrev" from shaft center longitudinal axis.

The elements as described are sufficient to position the rotor apices in close proximity to annular wall, however there is no provision as yet described to support said rotor by a shaft in said second end wall.

A second crank is comprised of a second center shaft, a second crank web, and a second eccentric shaft that are rigidly connected. A second end wall hole allows said second center shaft to pass through said second end wall, said second center shaft rotatably mounted in second end wall by a second center shaft bearing inline with center shaft longitudinal axis.

A rotor gear hub bore passes through said rotor gear hub and said rotor gear, said rotor gear hub bore in line with rotor center longitudinal axis, said second eccentric shaft rotatably mounted within said rotor gear hub bore. The passage of said second eccentric shaft to forward of said rotor gear is significant in that connecting to said first crank web is possible.

The terminology referring to the directly accessible and not directly accessible configurations can be understood as follows. The first auxiliary center shaft is directly accessible forward of the machine so direct coupling to a power takeoff is possible. The first center shaft is not directly accessible forward of the machine because it is blocked from direct power takeoff by said stationary gear hub retainer. Direct access to said second eccentric shaft is possible rearward of said rotor and thus connection of said second eccentric shaft to second crank web is made possible. The first eccentric shaft is not directly accessible rearward of said rotor because said rotor gear hub flange 154 blocks the passage.

In accordance with the first embodiment, it should be understood that the reversing element could have been a timing belt or combination of gears. The rotor positioning mechanism differs from the more familiar internal gear as the positioning element on the rotor in the sense that it does not fit around the stationary element in the cross section of engagement, which has the effect of creating the restrictions for the shaft. The concept of the reversing gear or timing belt in and of itself is not novel but requires the adoption of the shaft configurations as described for use in this class of rotary machine.

There are no seals on the side of the rotor shown, but this can be accomplished in by a variety of methods as described in prior art.

Second Embodiment

A second embodiment of the present invention will be described. A configuration is employed with the stationary gear hub passing through the forward center shaft, which causes the gear hub retainer to block the forward center shaft from direct coupling. The eccentric shaft of the crank passes through the rotor gear hub and rotor gear allowing the eccentric shaft to connect to the rearward shaft web. This and other aspects related to isolation of the rotor positioning mechanism from the flow medium will become apparent in the following description.

An outer housing having an inwardly facing annular wall, a first end wall, and a second end wall when joined form a machine chamber. A designation forward will henceforth be synonymous with the direction of the first end wall from the machine chamber.

A rotor is disposed in said machine chamber for eccentric rotation therein, said rotor having two curved faces meeting at two apexes arranged symmetrically about a rotor center longitudinal axis. A rotor positioning mechanism keeps said apexes moving in close proximity with said annular wall to form a pressure seal. A first rotor end and a second rotor end extend in parallel fashion between said curved faces, and form a pressure seal with first end wall and second end wall by moving in parallel fashion while in close proximity.

A first pressure housing extends forward from said first end wall, said first pressure housing having a first pressure housing cover attached to forward end, said first pressure housing having a first pressure chamber disposed therein.

A first crank is comprised of a first center shaft and first crank web, said first center shaft having a shaft center longitudinal axis offset from said rotor center longitudinal axis by a crank length. A first pressure cover hole allows passage of said first center shaft to forward of said first pressure housing cover, said first center shaft joumaled in said first pressure housing cover in a first center shaft bearing inline with shaft center longitudinal axis. A gear case is fitted to rearward of said first crank web and can be pressed or bolted on to make a tight seal.

A first shaft end wall is attached to said gear case in a first shaft housing retainer hole by a cylindrical first shaft housing retainer projecting forward from said first shaft end wall. The first shaft end wall has a cylindrical periphery that slidingly engages inner surface of a first end wall hole to make a pressure seal. The first shaft end wall also has an inwardly facing first shaft side wall parallel to said first rotor end and moving in close proximity to make a pressure seal.

A second pressure housing extends rearward from said second end wall, said second pressure housing having a second pressure housing cover attached to rearward end, said second pressure housing having a second pressure chamber disposed therein.

A second crank is comprised of a second center shaft, a second crank web, and a second eccentric shaft that are rigidly connected. A second pressure cover hole allows passage of said second center shaft to rearward of said second pressure housing cover, said second center shaft joumaled in said second pressure housing cover by a second center shaft bearing inline with shaft center longitudinal axis.

A second shaft end wall is attached to said second crank web in a second shaft housing retainer hole by a cylindrical second shaft housing retainer projecting rearward from said second shaft end wall. The second shaft end wall has a cylindrical periphery that slidingly engages inner surface of a second end wall hole to make a pressure seal. The second shaft end wall also has an inwardly facing second shaft side wall parallel to said second rotor end and moving in close proximity to make a pressure seal.

A rotor gear hub passes through a hole in rotor and is firmly attached therein, said rotor gear hub extending beyond said first rotor end and said second rotor end. A first shaft side wall hole and a gear case hole allow passage of said rotor gear hub forward into said gear case. A second shaft side wall hole allows passage of said rotor gear hub to rearward of second shaft end wall. A rotor gear hub bore passes the entire length of said rotor gear hub, said second eccentric shaft rotatably mounted in said rotor gear hub bore in line with rotor center longitudinal axis to form a driving contact. A first crank web shaft retainer rigidly connects said second eccentric shaft to said first crank web forward of said rotor gear hub.

A first side pressure seal in said first shaft side wall hole seals between said rotor gear hub and said first shaft end wall forward of said rotor. A second side pressure seal in said second shaft side wall hole seals between said rotor gear hub and said second shaft end wall rearward of said rotor.

A gear case rotor hub seal provides a lubrication seal between said gear case hole and said rotor gear hub from said first pressure chamber, said rotor gear hub rotating within said gear case rotor hub seal. Additional pressure seals may be employed between the said rotor gear hub and said gear case. The volume enclosed within said gear case is completely isolated from said first pressure chamber by said gear case rotor hub seal.

A rotor gear hub oil seal seals between said second eccentric shaft and the rearward end of said rotor gear hub, said rotor gear hub oil seal isolating rotatable mount of said second eccentric shaft in said rotor gear hub bore from said second pressure chamber.

A first center shaft seal located rearward of said first center shaft bearing in said first pressure cover hole isolates said first center shaft bearing from said first pressure chamber. A first bearing outer seal isolates said first center shaft bearing from the output section not yet described.

A second center shaft seal located forward of said second center shaft bearing in said second pressure cover hole isolates said second shaft bearing from said second pressure chamber.

The second embodiment as yet described has all the necessary elements for a rotary machine that has no means for positioning the apices in close proximity to the annular wall. In other words the rotor could rotate freely on the eccentric shaft of the crank without the annular wall to interact with the apices. The concept of the side pressure chamber is in one form or another addressed in prior art. The crank webs are in the side pressure chambers and so is the opening to the eccentric bearing. It becomes apparent to those skilled in the art that many layers of isolation and temperature control to handle heat and corrosives within the machine chamber are possible.

A stationary gear is mounted on a stationary gear hub in line with said shaft center longitudinal axis and rearward of said first crank web. A first center shaft bore allows said stationary gear hub to pass forward of said first center shaft, said stationary gear hub rotatably mounted in said first center shaft bore in line with said shaft center longitudinal axis. A stationary gear hub retainer is secured to said stationary gear hub, said second stationary gear hub retainer fastening to said first pressure housing cover. An oil seal can be used between said stationary gear hub and inside of said first center shaft bore or this can be used as a return to an oil case.

A rotor gear having 2 times the pitch diameter of said stationary gear is mounted on said rotor gear hub, said rotor gear centered on said rotor longitudinal axis, said second eccentric shaft maintaining alignment of said rotor gear.

A reversing gear is rotatably mounted on a reversing gear shaft pressed in a reversing gear shaft retainer rearward from said first crank web, said reversing gear shaft supported on the rearward side by a gear case reversing gear retainer.

The center longitudinal axis of said reversing gear is at a distance "De" from said rotor center longitudinal axis equal to half the pitch diameter "PDrot" of said rotor gear plus half the pitch diameter "PDrev" of said reversing gear. The center longitudinal axis of said reversing gear simultaneously is at a distance "Dc" equal to half the pitch diameter "PDst" of said stationary gear plus half the pitch diameter "PDrev" of said reversing gear from said shaft center longitudinal axis.

A power take off represented by an output gear is mounted on said first center shaft, a power takeoff being needed because said first center shaft can not pass beyond said stationary gear retainer.

A positive pressure of cool gases in said side pressure chambers can keep hot gases contained within said machine chamber and away from said hole in rotor. If said rotor is moving in close proximity but not touching inner walls of said machine chamber then it is possible to use materials such as steel alloys, ceramics, or graphite with resistant to high temperatures or having insulating characteristics.

BRIEF DESCRIPTION OF THE DRAWINGS

FIG. 3 is a side elevational view of the first embodiment of the rotary machine;

FIG. 4 is a cross sectional elevational view taken along the line 4-4 of FIG. 3;

FIG. 8 is an end elevational view of the second embodiment;

FIG. 9 is a cross sectional view taken along the line 9-9 of FIG. 8;

DETAILED DESCRIPTION OF THE PREFERRED EMBODIMENTS

Figure 1:
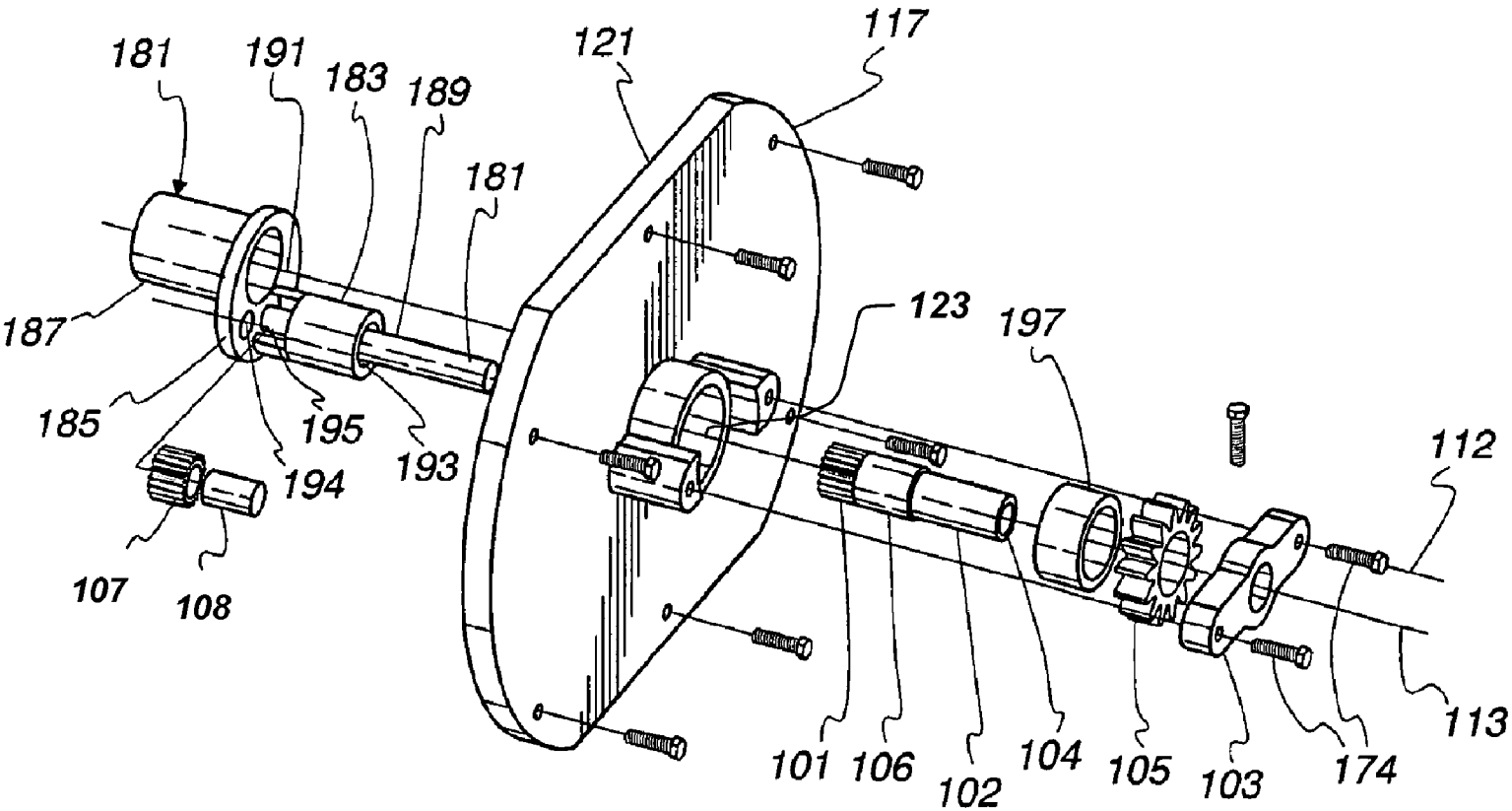
FIG. 1 is a fragmentary exploded perspective view of a first embodiment of a rotary machine according to principles of the present invention.
Figure 2:
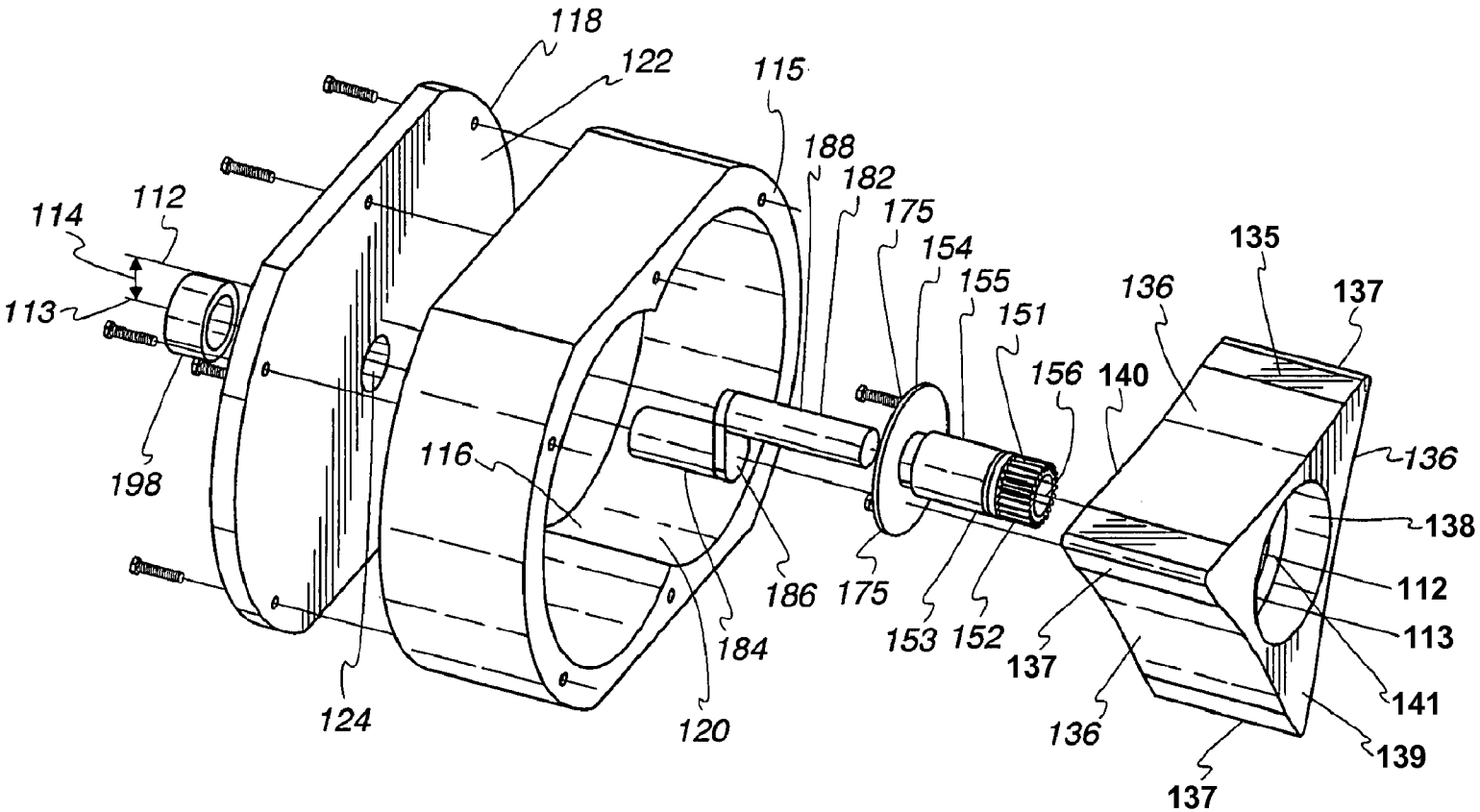
FIG. 2 is another exploded perspective view of a first embodiment of the rotary machine.

In certain embodiments of rotary machines, the present invention provides for at least one additional positioning element that is in a fixed position relative to the crank. The additional positioning element acts as a rotational reverse to reduce the rotation of the rotor by one half, one third or fractional equivalent of the reciprocal of a whole number as is understood from prior art. The reversing element can be a gear rotatably mounted on the shaft that engages a stationary spur gear and rotor mounted spur gear or a belt that is not actually connected to the crank arm in any way.

The shaft for a rotary machine of this type is often mistakenly disregarded as a crankshaft in a piston cylinder machine. However, this is really not the case. There is in the most basic sense an eccentric shaft, two center shafts, and two crank webs. The crank web serves to connect a center shaft section to an eccentric shaft and can take on any shape and have sections to serve other functions such as balancing the shaft. The fundamental difference for this type of rotary engine from a piston cylinder lies in the piston position must be further controlled by a mechanism rather than the surface within the working volume, being the sides of the cylinder in the slider crank.

One aspect of the present invention differs significantly from prior art. This aspect involves being able to directly couple to the center shaft of the crank from the outside of the machine on the side of the positioning elements or forward of the machine, and likewise the eccentric shaft of the crank on the opposing side or rearward of the rotor. This concept can be applied to prior art but was not necessary to the description of prior art. Because there is a center shaft and an eccentric shaft connected by a crank web, there are four possible configurations.

A first configuration of a rotary machine according to principles of the present invention has a crank that is directly accessible forward of the machine and directly accessible rearward of the rotor. The stationary gear fits around the center shaft of the crank, as would be the case for the stationary gear of the Wankle configuration, and can pass to forward of the machine. The rotor gear and coupling to the rotor fits around the eccentric shaft and is attached to the rotor, and can be directly accessed rearward of the rotor in that the eccentric shaft can pass beyond the opposing side of the rotor. A reversing gear is rotatably mounted on the crank web, so as to engage with the stationary gear and rotor gear. The stationary gear is forward of the connection of the center shaft to the crank web while the rotor gear is rearward of the connection of the eccentric shaft to the crank web. This requires the crank web to cross from rearward of the region of engagement of the reversing gear and stationary gear to forward of the region of engagement of the reversing gear and rotor gear. This is in contrast to an internal gear used on the rotor which must be forward of the crank web.

The second configuration of a rotary machine according to principles of the present invention has a crank that is not directly accessible forward of the machine and directly accessible rearward of the rotor. The rotor gear is essentially the same as the first configuration in that the rotor gear and connection to the rotor fit entirely around the eccentric shaft. The stationary gear hub, however, passes through the center of the shaft and attaches to the housing. The center shaft can not pass to forward of the machine because the attachment of the stationary gear or gear hub must always be forward of the center shaft. A power takeoff such as a gear, belt, hydraulic or fan can be employed rearward of the attachment of the stationary gear to the housing. A reversing gear is rotatably mounted on the crank web, so as to engage with the stationary gear and rotor gear. The stationary gear must now at least in part be rearward of the connection of the center shaft to the crank web while the rotor gear is rearward of the connection of the eccentric shaft to the crank web. The crank web is now forward of the region of engagement of the reversing gear and stationary gear, while also being forward of the region of engagement of the reversing gear and rotor gear.

To contrast this to the first configuration, consider a case with the crank fixed and the housing and rotor rotating. The movement of the connection between the stationary gear and the housing isolates the crank, however, the crank can be held from the opposing side of the rotor. The crank not being directly accessible from the front of the machine does not preclude rotatably mounting the shaft in the forward housing. The crank can therefore be rotatably mounted on both sides of the rotor. This is an interesting example in that there is no eccentric motion of any of the parts, and the housing can be rotatably mounted externally. Proper balancing can allow much higher RPM capabilities without the resulting centrifugal forces developing on the eccentric shaft.

The third configuration of a rotary machine according to principles of the present invention has a crank that is directly accessible forward of the machine and not directly accessible rearward of the rotor. The stationary gear is essentially the same as described for the first configuration and fits around the shaft, which allows for attachment to the housing without isolating the center shaft of the crank. The rotor gear hub however passes through the center of the eccentric shaft and attaches to the rotor rearward of the eccentric shaft. The eccentric shaft is isolated by the attachment to the rotor assembly so the eccentric shaft cannot pass rearward beyond the rotor. A second crank can be rotatably mounted in the rearward housing but not physically connect to the forward crank without passing forward through the rotor gear, which would then be elements of the first and second configuration.

The fourth configuration of a rotary machine according to principles of the present invention has a crank that is not directly accessible forward of the machine and not directly accessible rearward of the rotor gear. The stationary gear hub passes through the center of the shaft, and the rotor gear hub passes through the center of the eccentric portion of the shaft. The center shaft connects to the crank web forward of the engagement of the stationary gear and reversing gear and the eccentric shaft connects to the crank web rearward of the engagement of the rotor gear and reversing gear.

The center shaft of the crank can therefor pass around the stationary gear, pass through the stationary gear, or both of the described variations simultaneously. The eccentric shaft of the crank can likewise pass through the rotor spur gear, around the rotor spur gear, or both simultaneously. The use of the timing belt instead of the reversing gear applies to the same four variations. A set of two right angle drive units used as a gear reduction again is subject to the same four variations. Any reversing element transferring an interaction from a stationary element to a rotor element is subject to the four configurations. This will become apparent from the description of the following embodiments.

First Embodiment

FIG. 1 through FIG. 5 shows a first embodiment of the present invention that comprises all four configurations referred to above.

An outer housing 115 having an inwardly facing annular wall 116, a first side housing 117 having a first end wall 121, and a second side housing 118 having a second end wall 122 when joined together form a machine chamber 120. The first end wall 121 can be thought can be thought of as the forward end wall. A forward direction is denoted as the direction of said first end wall 121 from machine chamber 120 and a rearward direction as the direction of second end wall 122 from machine chamber 120.

A rotor 135 is disposed in machine chamber 120 for eccentric rotation therein, said rotor 135 having three curved faces 136 meeting at three apices 137 arranged symmetrically about a rotor central longitudinal axis 112. A first rotor end 139 and a second rotor end 140 extend in parallel fashion between said curved faces 136 and create a pressure seal by moving in close proximity to said first end wall 121 and said second end wall 122. A rotor positioning mechanism causes said apices 137 to always move in close proximity to annular wall 116 to form a pressure seal A first crank 181 is comprised of a first center shaft 183, a first crank web 185, a first eccentric shaft 187, and a first auxiliary center shaft 189 and has a center shaft longitudinal axis 113 offset from said rotor center longitudinal axis 112 by a crank length 114. A first end wall hole 123 allows passage of said first center shaft 183 to forward of said first side housing 117, said first center shaft 183 journaled in said first side housing 117 by a first center shaft bearing 197 inline with said center shaft longitudinal axis 113.

A rotor cylindrical bore 141 is displaced in line with rotor central longitudinal axis 112 in a hole in rotor 138, said first eccentric shaft 187 journaled within said rotor cylindrical bore 141 to form a driving contact.

A stationary gear 101 having a pitch diameter "PDst" rigidly connects to a stationary gear hub 102 inline with center shaft longitudinal axis 113, said stationary gear hub 102 secured to a stationary gear hub retainer 103, said stationary gear retainer 103 fastened to first side housing 117 by bolts 174. A first center shaft bore 193 extends from forward of said first center shaft 183 into crank web 185. Although not a requirement, said stationary gear hub 102 is rotatably mounted within said first center shaft bore 193 by stationary gear hub bearing 106 for the purpose of maintaining better alignment with said shaft center longitudinal axis 113. Direct access to said first center shaft 183 is blocked on the forward side by said stationary gear hub retainer 103 and can not be directly coupled, so a power takeoff gear 105 is shown as an example of indirect coupling to the shaft.

A stationary gear hub bore 104 passes from forward of said stationary gear hub retainer 103 to rearward of said stationary gear 101 with said first auxiliary center shaft 189 rigidly affixed to said first crank web 185 and passing to forward of said stationary gear hub retainer 103. Although not a requirement for this embodiment, the auxiliary first center shaft 189 is rotatably mounted within said stationary gear hub bore 104 inline with said center shaft longitudinal axis 113 for maintaining better alignment of stationary gear 101. Said auxiliary first center shaft 189 is directly accessible from forward of the machine. One should also note that the first center shaft 183 rotatably mounted by the first center shaft bore 193 on the outside of the stationary gear hub 102 could act as the sole rotary mount for the first center shaft 183.

A rotor gear assembly 151 comprising a rotor gear 152 inline with said rotor center longitudinal axis 112 with a pitch diameter "PDrot" equal to 1.5 times "PDst", a rotor gear hub 153, and a rotor gear hub flange 154, said rotor gear hub flange 154 attaching to said rotor 135. A first eccentric shaft bore 191 extends from rearward of said first eccentric shaft 187 to forward of said first crank web 185 in line with said rotor center longitudinal axis 112, said rotor gear hub 153 rotatably mounted therein by a rotor gear hub bearing 155. Direct access to said first eccentric shaft 187 rearward of said rotor 135 is blocked by said rotor gear hub flange 154, but said rotor gear hub 153 positions said rotor gear 152 forward of said first crank web 185 and helps maintain alignment.

A reversing gear 107 is rotatably mounted on a reversing gear shaft 108 rigidly mounted in a first crank web hole 194 on first crank web 185. A first center shaft cutout 195 in said first center shaft 183 allows reversing gear 107 to mesh with stationary gear 101, said reversing gear 107 also engaging said rotor gear 152, said first center shaft cutout 195 allowing clearance for said rotor gear 152.

Figure 5:
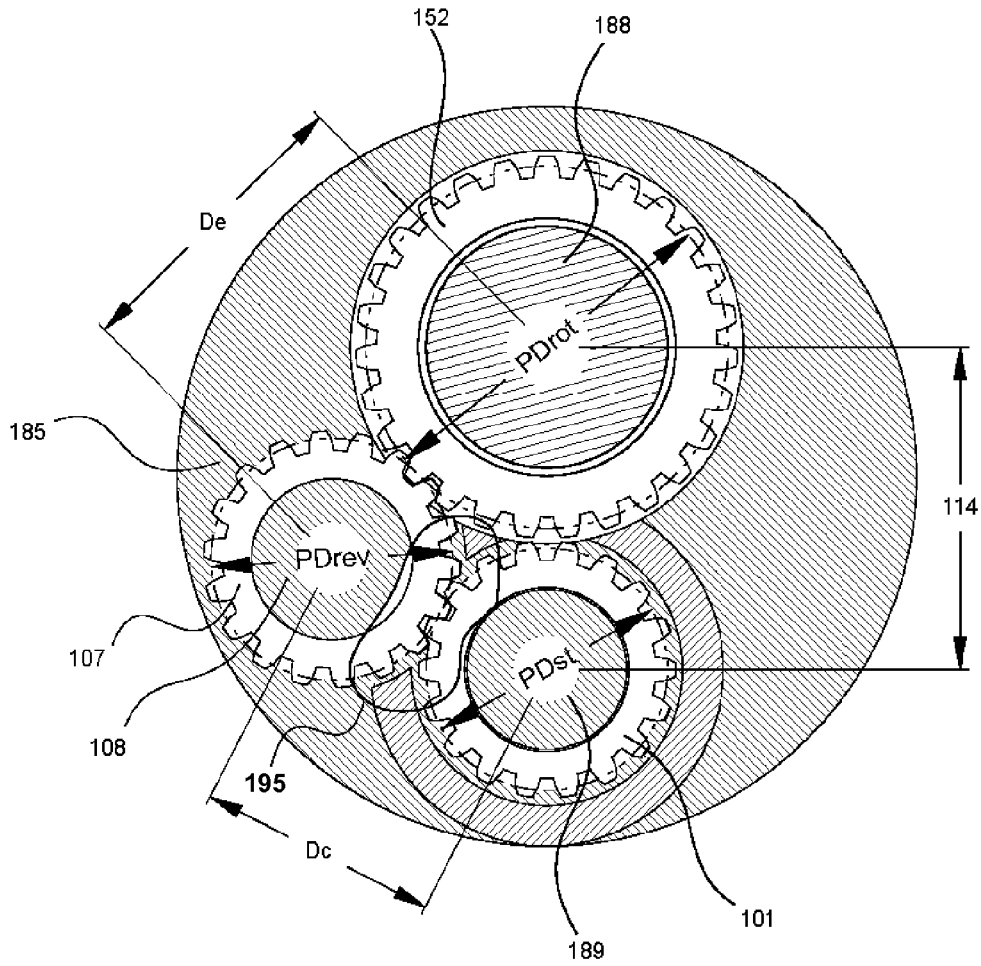
FIG. 5 is a fragmentary cross-sectional view taken along the line 5-5 of FIG. 4.
Figure 6:
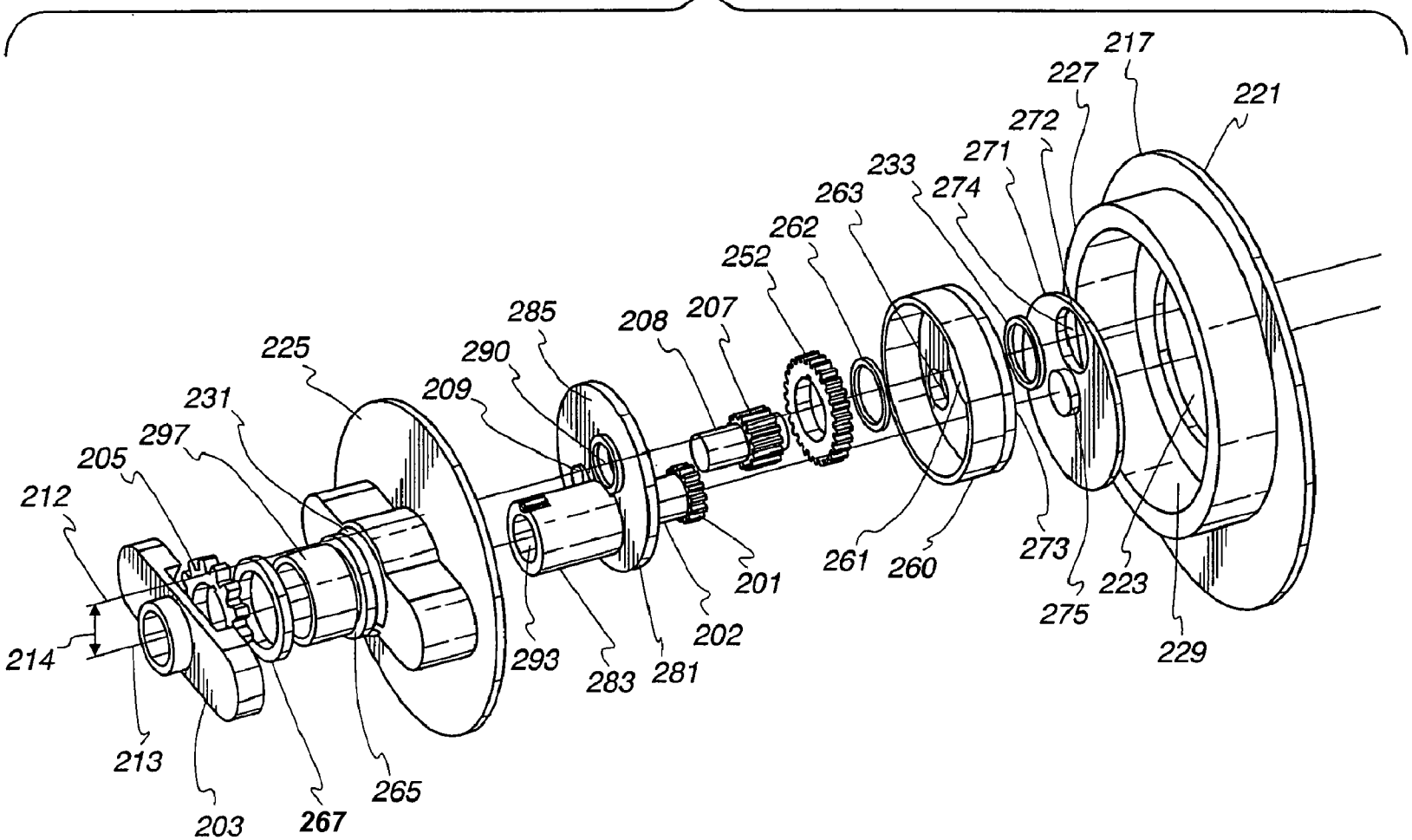
FIG. 6 is a fragmentary exploded perspective view of a second embodiment of a rotary machine according to principles of the present invention.
Figure 7:
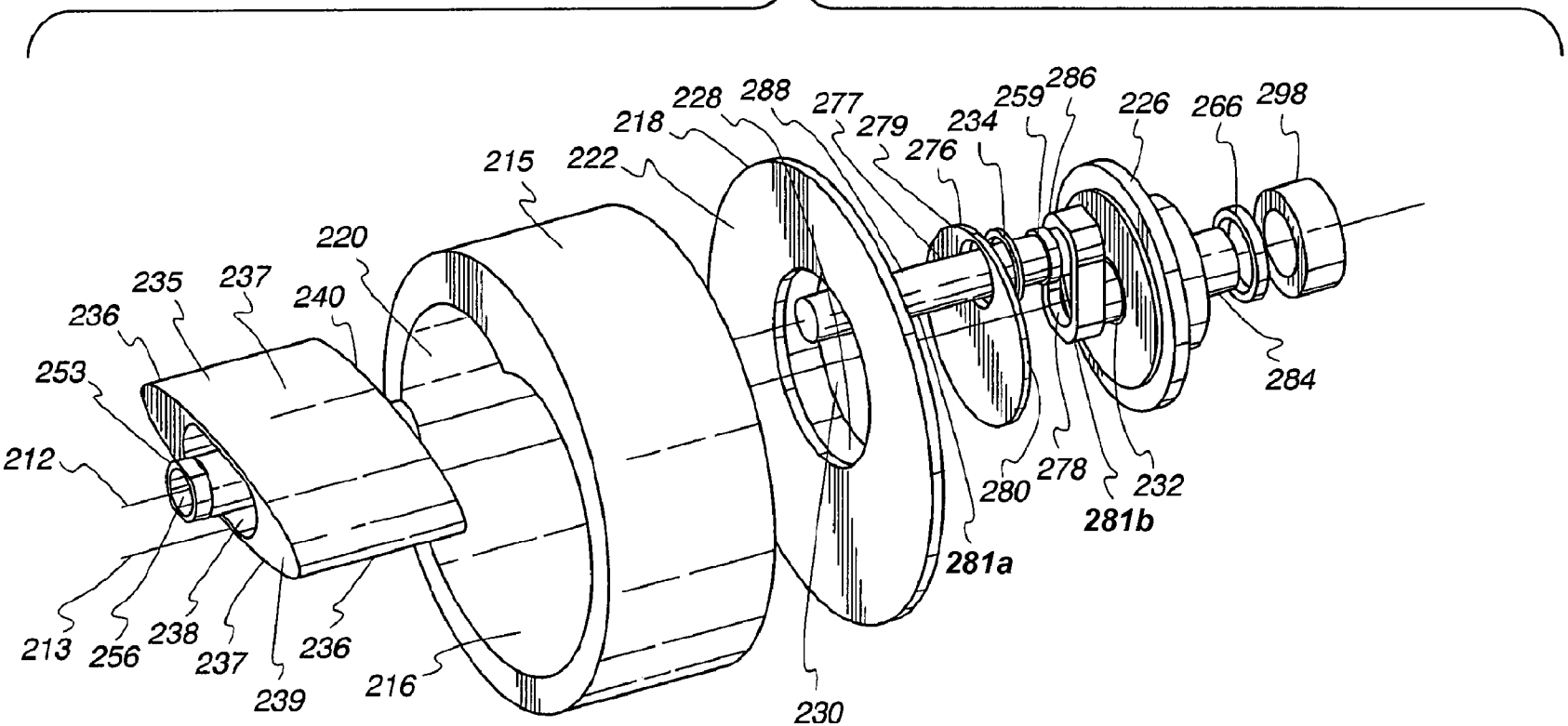
FIG. 7 is another fragmentary exploded perspective view of the second embodiment of the rotary machine.

Referring specifically to FIG. 5, A center longitudinal axis of said reversing gear 107 is at a distance of one half the rotor gear 152 pitch diameter "PDrot" plus one half the reversing gear 107 pitch diameter "P Drev" from rotor center longitudinal axis 112. The center longitudinal axis of said reversing gear 107 at the same time is at a distance of one half said stationary gear 101 pitch diameter "PDst" plus one half said reversing gear 107 pitch diameter "P Drev" from shaft center longitudinal axis 113.

The elements as described are sufficient to position the rotor apices 137 in close proximity to annular wall 116, however there is no provision as yet described to support said rotor 135 by a shaft in said second side housing 118.

A second crank 182 is comprised of a second center shaft 184, a second crank web 186, and a second eccentric shaft 188 that are rigidly connected. A second end wall hole 124 allows said second center shaft 184 to pass through said second end wall 122, said second center shaft 184 rotatably mounted in second side housing 118 by a second center shaft bearing 198 inline with center shaft longitudinal axis 113.

A rotor gear hub bore 156 passes through said rotor gear hub 153 and said rotor gear 152, said rotor gear hub bore 156 in line with rotor center longitudinal axis 112, said second eccentric shaft 188 rotatably mounted within said rotor gear hub bore 156. The passage of said second eccentric shaft 188 to forward of said rotor gear 152 is significant in that attachment to said first crank web 185 is possible.

The terminology referring to the directly accessible and not directly accessible configurations can be understood as follows. The first auxiliary center shaft 189 is directly accessible forward of the machine so direct coupling to a power takeoff is possible. The first center shaft 183 is not directly accessible forward of the machine because it is blocked from direct power takeoff by said stationary gear hub retainer 103. Direct access to said second eccentric shaft 188 is possible rearward of said rotor 135 and thus connection of said second eccentric shaft 188 to second crank web 186 is made possible. The first eccentric shaft 187 is not directly accessible rearward of said rotor 135 because said rotor gear hub flange 154 blocks the passage.

In accordance with the first embodiment, it should be understood that the reversing element could have been a timing belt or combination of gears. The rotor positioning mechanism differs from the more familiar internal gear as the positioning element on the rotor in the sense that it does not fit around the stationary element in the cross section of engagement, which has the effect of creating the restrictions for the shaft. The concept of the reversing gear or timing belt in and of itself is not novel but requires the adoption of the shaft configurations as described for use in this class of rotary machine.

Second Embodiment

A second embodiment will be described for a two-lobe configuration having the stationary gear forward of the crank web. The rotor positioning mechanism is not within the rotor so that the rotor can have dimensions suited only for the intended purpose. The completely enclosed positioning mechanism is also better isolated from heat and corrosives.

FIG. 6 through FIG. 10 shows a second embodiment of the present invention that encompasses a configuration of a rotary machine according to principles of the present invention with a crank that is not directly accessible forward of the machine and directly accessible rearward of the rotor. The stationary gear hub passes through the forward center shaft, which causes the gear hub retainer to block the forward center shaft from direct coupling. The eccentric shaft of the crank passes through the rotor gear hub and rotor gear allowing the eccentric shaft to connect to a rearward crank web. This and other aspects related to isolation of the rotor positioning mechanism from the flow medium will become apparent in the description of the second embodiment.

An outer housing 215 having an inwardly facing annular wall 216, a first end wall 217 having a first end wall 221, and a second end wall 218 having a second end wall 222 when joined form a machine chamber 220. A designation forward will henceforth be synonymous with the direction of the first end wall from the machine chamber.

A rotor 235 is disposed in said machine chamber 220 for eccentric rotation therein, said rotor 235 having two curved faces 237 meeting at two apexes 236 arranged symmetrically about a rotor center longitudinal axis 212. A rotor positioning mechanism keeps said apexes 236 moving in close proximity with said annular wall 216 to form a pressure seal. A first rotor end 239 and a second rotor end 240 extend in parallel fashion between said curved faces 236, and form a pressure seal with first end wall 221 and second end wall 222 by moving in parallel fashion while in close proximity.

A first pressure housing 227 extends forward from said first end wall 217, said first pressure housing 227 having a first pressure housing cover 225 attached to forward end, said first pressure housing 227 having a first pressure chamber 229 disposed therein.

A first crank 281 is comprised of a first center shaft 283 and first crank web 285, said first center shaft 283 having a shaft center longitudinal axis 213 offset from said rotor center longitudinal axis 212 by a crank length 214. A first pressure cover hole 231 allows passage of said first center shaft 283 to forward of said first pressure housing cover 225, said first center shaft 283 journaled in said first pressure housing cover 225 in a first center shaft bearing 297 inline with shaft center longitudinal axis 213. A gear case 260 is fitted to rearward of said first crank web 285 and can be pressed or bolted on to make a tight seal.

A first shaft end wall 271 is attached to said gear case 260 in a first shaft housing retainer hole 273 by a cylindrical first shaft housing retainer 275 projecting forward from said first shaft end wall 271. The first shaft end wall 271 has a cylindrical periphery that slidingly engages inner surface of a first end wall hole 223 to make a pressure seal. The first shaft end wall 271 also has an inwardly facing first shaft side wall 272 parallel to said first rotor end 231 and moving in close proximity to make a pressure seal.

A second pressure housing 228 extends rearward from said second end wall 218, said second pressure housing 228 having a second pressure housing cover 226 attached to rearward end, said second pressure housing 228 having a second pressure chamber 230 disposed therein.

A second crank 281*a,b* is comprised of a second center shaft 284, a second crank web 286, and a second eccentric shaft 288 that are rigidly connected. A second pressure cover hole 232 allows passage of said second center shaft 284 to rearward of said second pressure housing cover 218, said second center shaft 284 journaled in said second pressure housing cover 226 by a second center shaft bearing 298 inline with shaft center longitudinal axis 213.

A second shaft end wall 276 is attached to said second crank web 285 in a second shaft housing retainer hole 278 by a cylindrical second shaft housing retainer 280 projecting rearward from said second shaft end wall 276. The second shaft end wall 276 has a cylindrical periphery that slidingly engages inner surface of a second end wall hole 224 to make a pressure seal. The second shaft end wall 276 also has an inwardly facing second shaft side wall 277 parallel to said second rotor end 232 and moving in close proximity to make a pressure seal.

A rotor gear hub 253 passes through a hole in rotor 238 and is firmly attached therein, said rotor gear hub 253 extending beyond said first rotor end 231 and said second rotor end 232. A first shaft side wall hole 274 and a gear case hole 261 allow passage of said rotor gear hub 253 forward into said gear case 260. A second shaft side wall hole 279 allows passage of said rotor gear hub 253 to rearward of second shaft end wall 276. A rotor gear hub bore 256 passes the entire length of said rotor gear hub 253, said second eccentric shaft 288 rotatably mounted in said rotor gear hub bore 256 in line with rotor center longitudinal axis 212 to form a driving contact. A first crank web shaft retainer 290 rigidly connects said second eccentric shaft 288 to said first crank web 285 forward of said rotor gear hub 253.

A first side pressure seal 233 in said first shaft side wall hole 274 seals between said rotor gear hub 253 and said first shaft end wall 271 forward of said rotor 235. A second side pressure seal 234 in said second shaft side wall hole seals between said rotor gear hub 253 and said second shaft end wall 276 rearward of said rotor 235.

A gear case rotor hub seal 262 provides a lubrication seal between said gear case hole 261 and said rotor gear hub 253 from said first pressure chamber 229, said rotor gear hub 253 rotating within said gear case rotor hub seal 262. Additional pressure seals may be employed between said rotor gear hub 253 and said gear case 260. The volume enclosed within said gear case is completely isolated from said first pressure chamber 229 by said gear case rotor hub seal 262.

A rotor gear hub oil seal 259 seals between said second eccentric shaft 288 and the rearward end of said rotor gear hub 253, said rotor gear hub oil seal 259 isolating rotatable mount of said second eccentric shaft 288 in said rotor gear hub bore 256 from said second pressure chamber 230.

A first center shaft seal 265 located rearward of said first center shaft bearing 297 in said first pressure cover hole 231 isolates said first center shaft bearing 297 from said first pressure chamber 229. A first bearing outer seal 267 isolates said first center shaft bearing 297 from the output section not yet described.

A second center shaft seal 266 located forward of said first center shaft bearing 298 is said second pressure cover hole 232 isolates said second shaft bearing 298 from said second pressure chamber 230.

The second embodiment as yet described has all the necessary elements for a rotary machine that has no means for positioning the apices in close proximity to the annular wall. In other words, the rotor could rotate freely on the eccentric shaft of the crank without the annular wall to interact with the apices. The concept of the side pressure chamber is in one form or another addressed in prior art. The crank webs are in the side pressure chambers and so is the opening to the eccentric bearing. It becomes apparent to those skilled in the art that many layers of isolation and temperature control to handle heat and corrosives within the machine chamber are possible.

A stationary gear 201 is mounted on a stationary gear hub 202 in line with said shaft center longitudinal axis 213 and rearward of said first crank web 285. A first center shaft bore 293 allows said stationary gear hub 201 to pass forward of said first center shaft 283, said stationary gear hub 202 rotatably mounted in said first center shaft bore 293 in line with said shaft center longitudinal axis 213. A stationary gear hub retainer 203 is secured to said stationary gear hub 202, said second stationary gear hub retainer 203 fastening to said first pressure housing cover 225. An oil seal can be used between said stationary gear hub 202 and inside of said first center shaft bore 293 or this can be used as a return to an oil case.

A rotor gear 252 having 2 times the pitch diameter of said stationary gear 201 is mounted on said rotor gear hub 253, said rotor gear 252 centered on said rotor longitudinal axis 212, said second eccentric shaft 288 maintaining alignment of said rotor gear 252.

A reversing gear 207 is rotatably mounted on a reversing gear shaft 208 pressed in a reversing gear shaft retainer 209 rearward from said first crank web 285, said reversing gear shaft 208 supported on the rearward side by a gear case reversing gear retainer 263.

Figure 10:
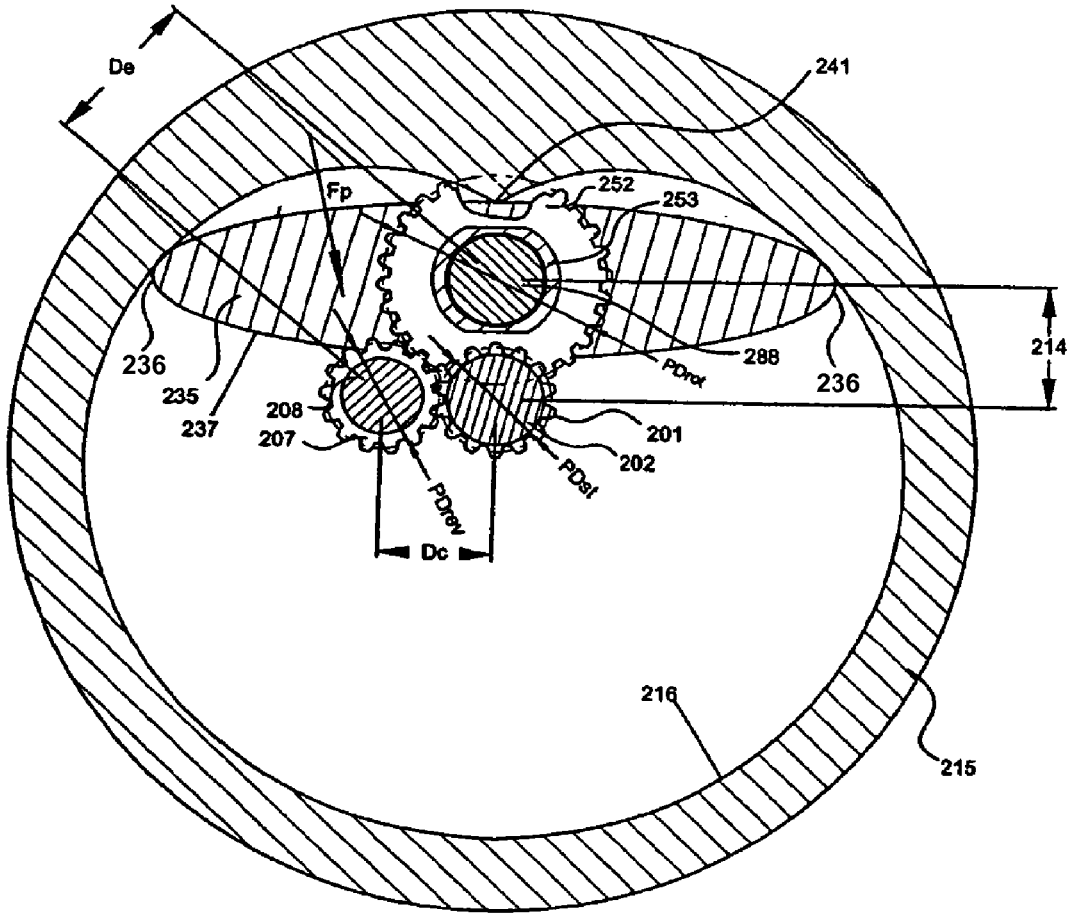
FIG. 10 is a cutaway plan end view of certain elements of the rotary machine of FIG. 9.

Referring now specifically to FIG. 10, the center longitudinal axis of said reversing gear 207 is at a distance "De" from said rotor center longitudinal axis 212 equal to half the pitch diameter "PDrot" of said rotor gear 252 plus half the pitch diameter "PDrev" of said reversing gear 207. The center longitudinal axis of said reversing gear 207 simultaneously is at a distance "De" equal to half the pitch diameter "PDst" of said stationary gear 201 plus half the pitch diameter "PDrev" of said reversing gear 207 from said shaft center longitudinal axis 213.

The second embodiment is of an elliptical rotor design, which forms a seal at the housing protrusion 241 at the center of the minimum volume region against said two curved faces 237 and the rotor apices 236. This causes a pressure force to act upon one side of said rotor putting a load on the gears, said reversing gear 207 carrying much of this load to the stationary gear 201 and counteracting the force placed on said second eccentric shaft 288 driving contact. The converse is true for said reversing gear 253 located on the low-pressure side. A reversing gear placed on both sides of the stationary gear that are preloaded would help eliminate backlash of the gears. Any reversing element mounted for operation in a fixed position relative to the crank web must employ the crank configurations described.

A power take off represented by an output gear 205 is mounted on said first center shaft 283, a power takeoff being needed because said first center shaft 283 can not pass beyond said stationary gear retainer 203.

A positive pressure of cool gases in said side pressure chambers can keep hot gases contained within said machine chamber and away from said hole in rotor. If said rotor is moving in close proximity but not touching inner walls of said machine chamber then it is possible to use materials such as steel alloys, ceramics, or graphite with resistant to high temperatures or having insulating characteristics.

Third Embodiment

Figure 11:
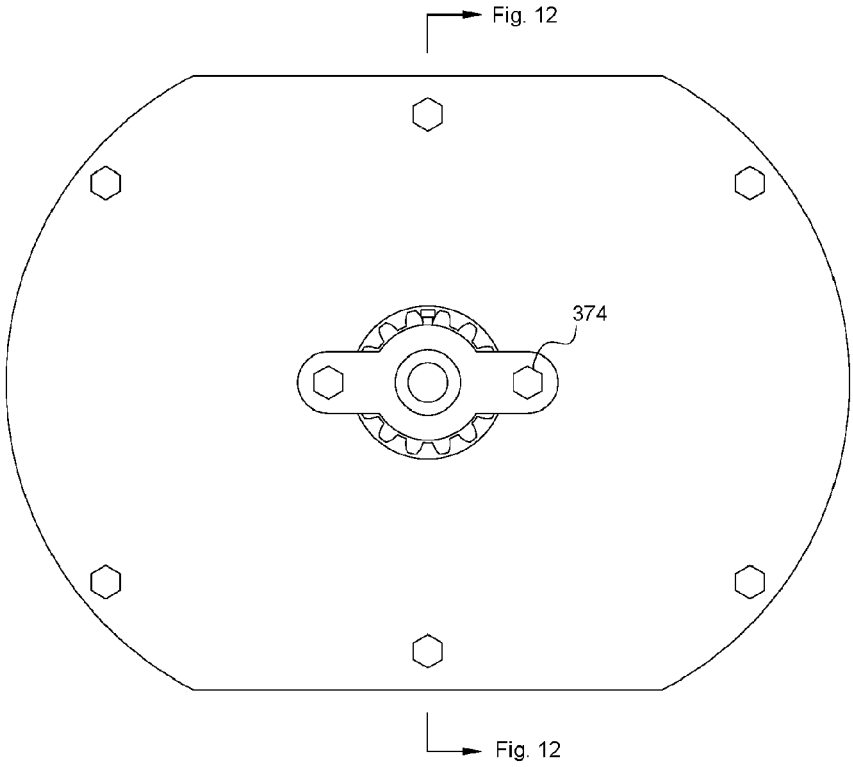
FIG. 11 is an elevational view of a third embodiment of a rotary machine according to principles of the present invention.
Figure 12:
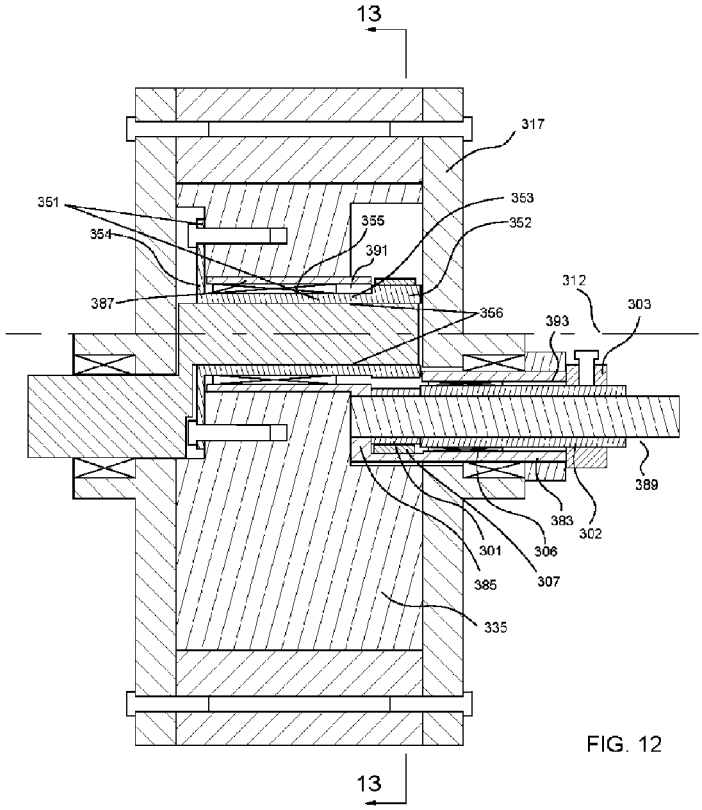
FIG. 12 is a cross-sectional elevational view of the rotary machine of FIG. 11.
Figure 13:
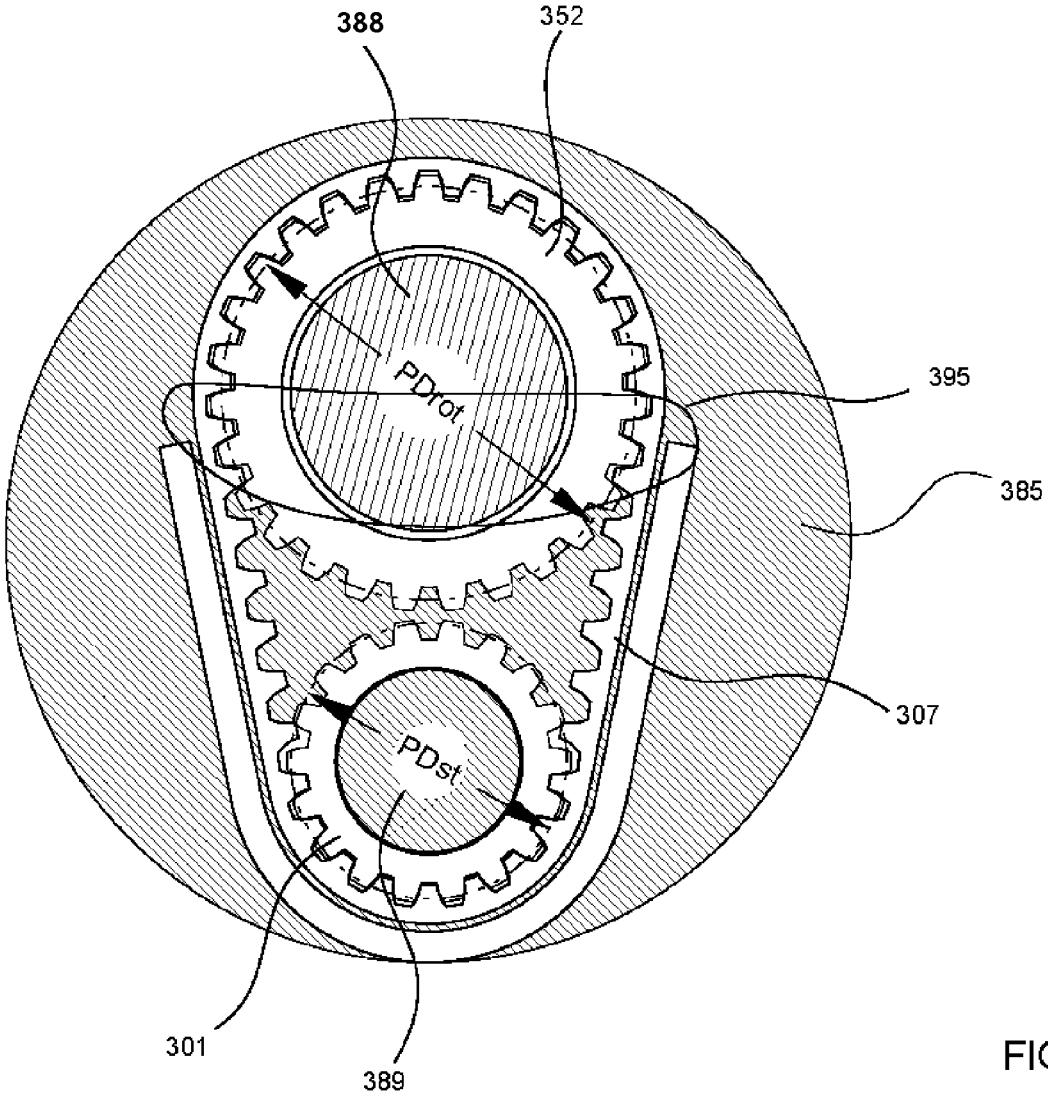
FIG. 13 is a fragmentary cross-sectional view taken along the line 13-13 of FIG. 12.

FIGS. 11 through 13 show a third embodiment that is similar to the first embodiment except a timing belt and toothed pulleys replace the gear assemblies. The elements described below are substantially identical to those corresponding elements of the first preferred embodiment with the exception of the timing belt 307.

A stationary toothed pulley 301 having a pitch diameter "PDst" rigidly connects to a stationary toothed pulley hub 302 inline with center shaft longitudinal axis 313, said stationary toothed pulley hub 302 secured to a stationary toothed pulley hub retainer 303, said stationary toothed pulley retainer 303 fastened to first side housing 317 by bolts 374. A first center shaft bore 393 extends from forward of first center shaft 383 into crank web 385. Although not a requirement, said stationary toothed pulley hub 302 is rotatably mounted within said first center shaft bore 393 by a stationary toothed pulley hub bearing 306 for the purpose of maintaining better alignment with said shaft center longitudinal axis 313. Direct access to said first center shaft 383 is blocked on the forward side by said stationary toothed pulley hub retainer 303 and can not be directly coupled.

A stationary toothed pulley hub bore passes from forward of said stationary toothed pulley hub retainer 303 to rearward of said stationary toothed pulley 301 with a first auxiliary center shaft 389 rigidly affixed to said first crank web 385 and passing to forward of said stationary gear hub retainer 303. Although not a requirement for this embodiment, an auxiliary first center shaft 389 is rotatably mounted within said stationary toothed pulley hub bore inline with said center shaft longitudinal axis 313 for maintaining better alignment of said stationary toothed pulley 301. Said auxiliary first center shaft 389 is directly accessible from forward of the machine. One should also note that the first center shaft 383 rotatably mounted by the first center shaft bore 193 on the outside of the stationary toothed pulley hub 302 could act as the sole rotary mount for the first center shaft 383.

A rotor toothed pulley assembly 351 includes a rotor toothed pulley 352 inline with a rotor center longitudinal axis 312 with a pitch diameter "PDrot" equal to 1.5 times "PDst", a rotor toothed pulley hub 353, and a rotor toothed pulley hub flange 354, said rotor toothed pulley hub flange 354 attaching to a rotor 335, and a rotor toothed pulley hub bore 356 passing through said rotor toothed pulley hub 353 and said rotor toothed pulley 352. A second eccentric shaft 388 is rotatably mounted within the rotor toothed pulley hub bore 356. A first eccentric shaft bore 391 extends from rearward of a first eccentric shaft 387 to forward of said first crank web 385 in line with said rotor center longitudinal axis 312, said rotor toothed pulley hub 353 rotatably mounted therein by a rotor toothed pulley hub bearing 355. Direct access to said first eccentric shaft 387 rearward of said rotor 335 is blocked by said rotor toothed pulley hub flange 354, but said rotor toothed pulley hub 353 positions said rotor toothed pulley 352 forward of said first crank web 385 and helDs maintain alignment.

A reversing timing belt 307 engages said stationary toothed pulley 301 and rotor toothed pulley 352. A first center shaft cutout 395 in said first center shaft 383 allows said reversing timing belt 307 to mesh with said stationary toothed pulley 301, said reversing timing belt 307 also meshing with said rotor toothed pulley 352.

A timing chain and sprockets is equivalent to the belt and pulleys. As stated at the end of the description of the first embodiment, there are still other types of reversing elements that could be conceived based on the four configurations discussed. The belt and pulleys considered sicinificant because it is well suited for low to moderate pressure differentials where no lubrication is desired. Additionally, the shaft can be held fixed while the chamber and rotor are rotating on a fixed axis which eliminates the oscillations caused by the rotating crank. The device can replace a turbo compressor or turbine while operating much quieter.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

That which is claimed is:

1. A rotary machine comprising:

a housing with spaced apart forward and rearward end walls and an interior wall defining a chamber;

a multi-lobe rotor in said chamber having curved faces meeting at apices, said apices being symmetrically arranged about a rotor axis, said apices positioned in close proximity to the interior wall of said housing, said rotor having parallel forward and rearward end faces extending between said curved faces, each of said parallel end faces facing one of said end walls, said parallel end faces being perpendicular to said rotor axis;

a crank with a center shaft extending along a shaft center axis offset from said rotor axis by a crank length distance, said center shaft extending through said chamber and rotatably mounted in the forward end wall, said crank including an eccentric shaft engaging at least one eccentric bearing supported by said rotor for forming driving contact between said center shaft and said rotor, said eccentric shaft and said eccentric bearing aligned with the rotor axis;

a stationary gear having a pitch radius and extending into the chamber from said forward end wall, said stationary gear rigidly mounted in said forward end wall, inline with the shaft center axis, said center shaft rotatably mounted in said forward end wall, inline with the shaft center axis, said center shaft passing through said stationary gear;

a crank web connecting said center shaft to the eccentric shaft, said crank web connected to said center shaft rearward of said stationary gear;

a rotor gear mounted to said rotor, inline with said rotor axis, said eccentric shaft passing through said rotor gear, and being connected to the crank web forward of said rotor gear, with said eccentric shaft directly accessible from the rearward side of said rotor;

the rotor gear having a rotor gear pitch radius greater than said stationary gear pitch radius by a ratio of the number of lobes of said rotor divided by the number of lobes of said rotor minus one;

a reversing gear having a pitch radius rotatably mounted on a reversing shaft, said reversing shaft rigidly mounted to the crank web, said reversing gear having a gear center axis offset from said center axis by a distance equal to said stationary gear pitch radius plus said reversing gear pitch radius;

said reversing gear having a gear center axis offset from said rotor axis by a distance equal to said rotor gear pitch radius plus said reversing gear pitch radius; and said reversing gear engaging said rotor gear and said stationary gear.

2. The rotary machine as claimed in claim 1, wherein said crank web of said reversing gear passes around the outside of said reversing gear from a point behind said stationary gear to a point forward of said reversing gear.

3. The rotary machine as claimed in claim 1, wherein said crank web of said reversing gear passes through said reversing gear from a point behind said stationary gear to a point forward of said reversing gear.

4. A rotary machine comprising:

a housing with spaced apart forward and rearward end walls and an interior wall defining a chamber;

a multi-lobe rotor in said chamber having curved faces meeting at apices, said apices being symmetrically arranged about a rotor axis, said apices positioned in close proximity to the interior wall of said housing, said rotor assembly having parallel forward and rearward end faces extending between said curved faces, each of said parallel end faces facing one of said end walls, said parallel end faces being perpendicular to said rotor axis;

a crank with a center shaft extending along a center axis offset from said rotor axis by a crank length distance, said center shaft extending through said chamber and rotatably mounted in the forward end wall, said crank including an eccentric shaft engaging at least one eccentric bearing supported by said rotor for forming driving contact between said center shaft and said rotor, said eccentric shaft and said eccentric bearing aligned with the rotor axis;

a stationary gear having a pitch radius and extending from said forward end wall, said stationary gear rigidly mounted to a stationary gear hub inline with said shaft center axis, said stationary gear hub mounted to said forward end wall, said center shaft rotatably mounted and aligned with said stationary gear;

a crank web connecting said center shaft to said eccentric shaft, said stationary gear hub passing through said center shaft from forward of said center shaft, said stationary gear being rearward of said crank web;

a rotor gear mounted to said rotor, inline with said rotor axis, said eccentric shaft passing through said rotor gear, and being connected to said crank web forward of said rotor gear, with said eccentric shaft directly accessible from the rearward end face of said rotor;

the rotor gear having a rotor gear pitch radius greater than said stationary gear pitch radius by a ratio of the number of lobes of said rotor divided by the number of lobes of said rotor minus one;

a reversing gear having a pitch radius, rotatably mounted on a reversing shaft, said reversing shaft rigidly mounted to said crank web, said reversing gear having a gear center axis offset from said center axis by a distance equal to said stationary gear pitch radius plus said reversing gear pitch radius;

said reversing gear having a gear center axis offset from said rotor axis by a distance equal to said rotor gear pitch radius plus said reversing gear pitch radius; and said reversing gear engaging said rotor gear and said stationary gear.

5. A rotary machine comprising:

a housing with spaced apart forward and rearward end walls and an interior wall defining a chamber;

a multi-lobe rotor in said chamber having curved faces meeting at apices, said apices being symmetrically arranged about a rotor axis, said apices positioned in close proximity to the interior wall of said housing, said rotor assembly having parallel forward and rearward end faces extending between said curved faces, each of said parallel end faces facing one of said end walls, said parallel end faces being perpendicular to said rotor axis;

a crank with a center shaft extending along a center axis offset from said rotor axis by a crank length distance, said center shaft extending through said chamber and rotatably mounted in the forward end wall, said crank including an eccentric shaft engaging at least one eccentric bearing supported by said rotor for forming driving contact between said center shaft and said rotor, said eccentric shaft and said eccentric bearing aligned with the rotor axis;

a stationary gear having a pitch radius and extending into said chamber from said forward end wall, said stationary gear rigidly mounted in said forward end wall, inline with said shaft center axis, said center shaft rotatably mounted in said forward end wall, inline with said shaft center axis, said center shaft passing through said stationary gear;

a crank web connecting said center shaft to the eccentric shaft, said crank web connected to said center shaft rearward of said stationary gear;

a rotor gear inline with the rotor axis, said rotor gear mounted to a rotor gear hub, passing from a point forward of said crank web through holes in said eccentric shaft and said crank web, said eccentric shaft blocked from direct access rearward of said rotor by rigid mount of said rotor gear hub to said rotor;

the rotor gear having a rotor gear pitch radius greater than said stationary gear pitch radius by a ratio of the number of lobes of said rotor divided by the number of lobes of said rotor minus one;

a reversing gear having a pitch radius, rotatably mounted on a reversing shaft, said reversing shaft rigidly mounted to said crank web, said reversing gear having a gear center axis offset from said center axis by a distance equal to said stationary gear pitch radius plus said reversing gear pitch radius;

said reversing gear having a gear center axis offset from said rotor axis by a distance equal to said rotor gear pitch radius plus said reversing gear pitch radius; and said reversing gear engaging said rotor gear and said stationary gear.

6. A rotary machine comprising:

a housing with spaced apart forward and rearward end walls and an interior wall defining a chamber;

a multi-lobe rotor in said chamber having curved faces meeting at apices, said apices being symmetrically arranged about a rotor axis, said apices positioned in close proximity to the interior wall of said housing, said rotor assembly having parallel forward and rearward end faces extending between said curved faces, each of said parallel end faces facing one of said end walls, said parallel end faces being perpendicular to said rotor axis;

a crank with a center shaft extending along a center axis offset from said rotor axis by a crank length distance, said center shaft extending through said chamber and rotatably mounted in the forward end wall, said crank including an eccentric shaft engaging at least one eccentric bearing supported by said rotor for forming driving contact between said center shaft and said rotor, said eccentric shaft and said eccentric bearing aligned with the rotor axis;

a stationary gear having a pitch radius and extending from said forward end wall, said stationary gear rigidly mounted to a stationary gear hub inline with said shaft center axis, said stationary gear hub mounted to said forward end wall, said center shaft rotatably mounted and aligned with said stationary gear, a crank web connecting said center shaft to said eccentric shaft, said stationary gear hub passing through said center shaft from forward of said center shaft, said stationary gear being rearward of said crank web;

a rotor gear inline with the rotor axis, said rotor gear mounted to a rotor gear hub, passing from a point forward of said crank web through holes in said eccentric shaft and said crank web, said eccentric shaft blocked from direct access rearward of said rotor by rigid mount of said rotor gear hub to said rotor;

the rotor gear having a rotor gear pitch radius greater than said stationary gear pitch radius by a ratio of the number of lobes of said rotor divided by the number of lobes of said rotor minus one;

a reversing gear having a pitch radius, rotatably mounted on a reversing shaft, said reversing shaft rigidly mounted to said crank web, said reversing gear having a gear center axis offset from said center axis by a distance equal to said stationary gear pitch radius plus said reversing gear pitch radius;

said reversing gear having a gear center axis offset from said rotor axis by a distance equal to said rotor gear pitch radius plus said reversing gear pitch radius; and said reversing gear engaging said rotor gear and said stationary gear.

7. The rotary machine as claimed in claim 6, further comprising said crank web of said reversing gear pass around the outside of said reversing gear from forward of said stationary gear to behind said reversing gear.

8. The rotary machine as claimed in claim 6, further comprising said crank web of said reversing gear pass through said reversing gear from forward of said stationary gear to behind of said reversing gear.

9. A rotary machine comprising:

a housing with spaced apart forward and rearward end walls and an interior wall defining a chamber;

a multi-lobe rotor in said chamber having curved faces meeting at apices, said apices being symmetrically arranged about a rotor axis, said apices positioned in close proximity to the interior wall of said housing, said rotor assembly having parallel forward and rearward end faces extending between said curved faces, each of said parallel end faces facing one of said end walls, said parallel end faces being perpendicular to said rotor axis;

a crank with a center shaft extending along a shaft center axis offset from said rotor axis by a crank length distance, said center shaft extending through said chamber and rotatably mounted in the forward end wall, said crank including an eccentric shaft engaging at least one eccentric bearing supported by said rotor for forming driving contact between said center shaft and said rotor, said eccentric shaft and said eccentric bearing aligned with the rotor axis;

a stationary toothed pulley having a radius and extending into said chamber from said forward end wall, said stationary toothed pulley rigidly mounted in said forward end wall, inline with said shaft center axis, said center shaft rotatably mounted in said forward end wall, inline with said shaft center axis, said center shaft passing through said stationary toothed pulley;

a crank web connecting said center shaft to the eccentric shaft, said crank web connected to said center shaft rearward of said stationary toothed pulley;

a rotor toothed pulley mounting to said rotor, inline with said rotor axis, said eccentric shaft passing through said rotor toothed pulley, said eccentric shaft being connected to said crank web forward of said rotor toothed pulley, said eccentric shaft directly accessible from the rearward end face of said rotor;

the rotor toothed pulley having a rotor toothed pulley radius greater than said stationary toothed pulley radius by a ratio of the number of lobes of said rotor divided by the number of lobes of said rotor minus one; and a timing belt coupling said stationary toothed pulley to said rotor toothed pulley.

10. A rotary machine comprising:

a housing with spaced apart forward and rearward end walls and an interior wall defining a chamber;

a multi-lobe rotor in said chamber having curved faces meeting at apices, said apices being symmetrically arranged about a rotor axis, said apices positioned in close proximity to the interior wall of said housing, said rotor assembly having parallel forward and rearward end faces extending between said curved faces, each of said parallel end faces facing one of said end walls, said parallel end faces being perpendicular to said rotor axis;

a crank with a center shaft extending along a center axis offset from said rotor axis by a crank length distance, said center shaft extending through said chamber and rotatably mounted in the forward end wall, said crank including an eccentric shaft engaging at least one eccentric bearing supported by said rotor for forming driving contact between said center shaft and said rotor, said eccentric shaft and said eccentric bearing aligned with the rotor axis;

a stationary toothed pulley having a pitch radius and extending from said forward end wall, said stationary toothed pulley rigidly mounted to a stationary toothed pulley hub inline with said shaft center axis, said stationary toothed pulley hub mounted to said forward end wall, said center shaft rotatably mounted and aligned with said stationary gear, a crank web connecting said center shaft to said eccentric shaft, said stationary toothed pulley hub passing through said center shaft from forward of said center shaft, said stationary toothed pulley being rearward of said crank web, said center shaft being isolated from direct coupling to power takeoff by mount of said stationary toothed pulley hub to said forward end wall;

a rotor toothed pulley mounted to said rotor, inline with said rotor axis, said eccentric shaft passing through said rotor toothed pulley, and being connected to said crank web forward of said rotor toothed pulley, with said eccentric shaft directly accessible from the rearward end face of said rotor;

the rotor toothed pulley having a rotor toothed pulley radius greater than said stationary toothed pulley pitch radius by a ratio of the number of lobes of said rotor divided by the number of lobes of said rotor minus one; and a timing belt coupling said stationary toothed pulley to said rotor toothed pulley.

11. A rotary machine comprising:

a housing with spaced apart forward and rearward end walls and an interior wall defining a chamber;

a multi-lobe rotor in said chamber having curved faces meeting at apices, said apices being symmetrically arranged about a rotor axis, said apices positioned in close proximity to the interior wall of said housing, said rotor assembly having parallel forward and rearward end faces extending between said curved faces, each of said parallel end faces facing one of said end walls, said parallel end faces being perpendicular to said rotor axis;

a crank with a center shaft extending along a center axis offset from said rotor axis by a crank length distance, said center shaft extending through said chamber and rotatably mounted in the forward end wall, said crank including an eccentric shaft engaging at least one eccentric bearing supported by said rotor for forming driving contact between said center shaft and said rotor, said eccentric shaft and said eccentric bearing aligned with the rotor axis;

a stationary toothed pulley gear having a pitch radius and extending into said chamber from said forward end wall, said stationary toothed pulley rigidly mounted in said forward end wall, inline with said shaft center axis, said center shaft rotatably mounted in said forward end wall, inline with said shaft center axis, said center shaft passing through said stationary toothed pulley;

a crank web connecting said center shaft to the eccentric shaft, said crank web connected to said center shaft rearward of said stationary toothed pulley;

a rotor toothed pulley is inline with the rotor axis, said rotor toothed pulley mounted to a rotor toothed pulley hub passing from a point forward of said crank web through holes in said eccentric shaft and said crank web, said eccentric shaft blocked from direct access rearward of said rotor by rigid mount of said rotor toothed pulley hub to said rotor;

the rotor toothed pulley having a rotor toothed pulley radius greater than said stationary toothed pulley radius by a ratio of the number of lobes of said rotor divided by the number of lobes of said rotor minus one; and a timing belt coupling said stationary toothed pulley to said rotor toothed pulley.

12. A rotary machine comprising:

a housing with spaced apart forward and rearward end walls and an interior wall defining a chamber;

a multi-lobe rotor in said chamber having curved faces meeting at apices, said apices being symmetrically arranged about a rotor axis, said apices positioned in close proximity to the interior wall of said housing, said rotor assembly having parallel forward and rearward end faces extending between said curved faces, each of said parallel end faces facing one of said end walls, said parallel end faces being perpendicular to said rotor axis;

a crank with a center shaft extending along a center axis offset from said rotor axis by a crank length distance, said center shaft extending through said chamber and rotatably mounted in the forward end wall, said crank including an eccentric shaft engaging at least one eccentric bearing supported by said rotor for forming driving contact between said center shaft and said rotor, said eccentric shaft and said eccentric bearing aligned with the rotor axis;

a stationary toothed pulley having a pitch radius and extending from said forward end wall, said stationary toothed pulley rigidly mounted to a stationary toothed pulley hub inline with said shaft center axis, said stationary toothed pulley hub mounted to said forward end wall, said center shaft rotatably mounted and aligned with said stationary toothed pulley, a crank web connecting said center shaft to said eccentric shaft, said stationary toothed hub passing through said center shaft from forward of said center shaft, said stationary toothed pulley being rearward of said crank web, said center shaft being isolated from direct coupling to power takeoff by mount of said stationary toothed pulley hub to said forward end wall;

a rotor toothed pulley inline with the rotor axis, said rotor toothed pulley mounted to a rotor toothed pulley hub passing from a point forward of said crank web through holes in said eccentric shaft and said crank web, said eccentric shaft blocked from direct access rearward of said rotor by rigid mount of said rotor toothed pulley hub to said rotor;

the rotor toothed pulley having a rotor toothed pulley radius greater than said stationary toothed pulley radius by a ratio of the number of lobes of said rotor divided by the number of lobes of said rotor minus one; and a timing belt coupling said stationary toothed pulley to said rotor toothed pulley.

* * * * *